US006382161B1

(12) United States Patent
Alex et al.

(10) Patent No.: US 6,382,161 B1
(45) Date of Patent: May 7, 2002

(54) AIR INDUCTION SYSTEM FOR INTERNAL COMBUSTION ENGINE

(75) Inventors: Matthias Alex, Heilbronn; Helmut Spannbauer, Moeglingen, both of (DE)

(73) Assignee: Filterwerk Mann & Hummel GmbH, Ludwigshafen (DE)

( * ) Notice: Subject to any disclaimer, the term of this patent is extended or adjusted under 35 U.S.C. 154(b) by 0 days.

(21) Appl. No.: 09/646,058

(22) PCT Filed: Mar. 4, 1999

(86) PCT No.: PCT/EP99/01399

§ 371 Date: Nov. 21, 2000

§ 102(e) Date: Nov. 21, 2000

(87) PCT Pub. No.: WO99/47807

PCT Pub. Date: Sep. 23, 1999

(30) Foreign Application Priority Data

Mar. 13, 1998 (DE) ..... 198 11 051

(51) Int. Cl.[7] ..... F02M 35/10

(52) U.S. Cl. ..... 123/184.53; 55/276; 181/229

(58) Field of Search ..... 123/184.53, 184.56; 181/229; 55/276

(56) References Cited

FOREIGN PATENT DOCUMENTS

JP 07-027028 * 1/1995

* cited by examiner

*Primary Examiner*—Noah P. Kamen
(74) *Attorney, Agent, or Firm*—Crowell & Moring LLP

(57) ABSTRACT

An air induction device (11) for an internal combustion engine including an air filter housing (12) with an open induction tube (13) leading away from it and a supplementary induction tube (14) having a closing element, preferably in the area of its end opening (15). The closing element may take the form of a rotary flap (17) and is actuated depending on engine speed. The housing (12) and the induction tubes (13, 14) are configured in geometrical terms in such a way that at low engine rotational speeds, the housing (12) and the open induction tube (13) form a Helmholtz resonator, while the closed supplementary induction tube (14) forms a quarter-wave tube leading from the housing (12). At higher engine rotational speeds, the supplementary induction tube (14) is opened, and the overall length of the supplementary induction tube (14) is adapted so that at the higher speeds, it forms a Helmholtz resonator with the air filter housing (12) and the open induction tube (13).

1 Claim, 2 Drawing Sheets

AIR INDUCTION SYSTEM FOR INTERNAL COMBUSTION ENGINE

The present invention relates to an air induction system for an internal combustion engine, with a housing for receiving an air filter and with a supply of air from at least two induction tubes. The air aspirated by such an air induction device is fed, after passing through the air filter it contains, into the individual combustion chambers. Since in this case the aspirated air forms a more or less continuous air column between the carburetor and valves and the intake openings of the air induction device and pulsates according to the rate of the opening and closing of the valves, a loud noise is created, mainly at the intake openings. Both this noise and the noise created by aspiration through a tube or the like, are to be damped as a secondary function in addition to the filtration of the intake air.

For this purpose an air induction tube is disclosed in German Patent No. 1,714,100, which leads into an air filter and forms two technically parallel flow channels of different length which, as a special feature, are joined together over their entire length by a slot. This slot has a width of a few millimeters for noise suppression by interference. The disadvantage here lies for one thing in the fact that. due to the connecting slot, the two channels must be arranged in a bundle, and for another thing that the noise suppression is considered insufficient.

A further solution is described in European Patent No. 242 797 in which an induction noise suppressor has two diffusers which vary in their cross section and lead into the induction noise suppressor. They are of equal length, but have different cross sections, they are uncoupled acoustically from one another, in contrast to the patent mentioned above, and each diffuser contains a shut-off means which can be actuated alternately according to the load on the motor and the motor speed. The suppression of the noise is accomplished substantially by the diffusers, which are opened alternately depending on the rotational speed range. The inherent frequency for the damping is determined by the average cross section of the diffuser that is open in each case, and by the use of the second diffuser an earlier starting suppression of the induction noise can thus be achieved. This solution, however, involves a considerable amount of trouble.

OBJECT AND SOLUTION

It is therefore the object of the invention to provide an air induction device whose use is as flexible as possible, which requires minor modifications of common commercial air intakes, and which enables optimum suppression of the induction noise at low cost.

This object is achieved by the fact that at least two induction tubes are of different length and closing means is associated with at least one induction tube and the latter is in the form of a supplementary induction tube. The difference in the lengths of the preferably two induction tubes permits construction together with the housing as a Helmholtz resonator, which suppresses induction noise in an especially advantageous manner. By means of the one closable induction tube the Helmholtz resonator can be tuned to two frequency ranges or rotational speed ranges, preferably one range for low to medium speeds and one for high rotational speeds. In one embodiment with a permanently open induction tube and a supplementary induction tube that can by closed by a closing means, a broadening or shifting of the frequency range is effected by switching in or opening the additional induction tube. The length is preferably such that, at a low frequency, corresponding for example to a motor speed of about 1000 rpm, it is tuned so that it corresponds approximately to half of the sound wavelength belonging to this frequency. In this way an optimum suppression of the noise is accomplished by interference, since no resonance can occur. Likewise, the length can of course amount to a multiple of the half wavelength. Since at low frequencies the wavelengths of the sound are greater, it is advantageous to make the open induction tube longer than the supplementary induction tube. Advantageously, the diameter of the always open induction tube is larger than that of the at least one supplementary induction tube. The cross section of the tubes is optional within certain limits, but an approximately circular cross section is preferred.

Especially advantageous is an embodiment in which the housing is configured as a resonator suppressing with the air supply the motor speed-related noise of the air induction, is connected to the motor preferably as a series resonator, and especially forms a Helmholtz resonator whose volume is variable by the closing means and can be adjusted to the rotational speed. In this way not only can the noise produced by the air intake of the motor can be better suppressed, but also through the use of the air filter housing with the induction tubes the number of necessary components can be kept low. Any desired air filter can be contained in the housing, for example a round or rectangular paper bellows filter.

A further improvement of the noise suppression, especially in the lower and medium speed range, can be achieved with the supplementary induction tube closed if in at least one closeable supplementary induction tube the closing means is mounted at a certain distance from the housing, preferably at the end of the supplementary induction tube. In this case when the supplementary induction tube is in the closed state, it forms a short tubular projection as an extension of the housing.

Advantageously, in one position at least one supplementary induction tube is closed by the closing means, and the housing and the open induction tube together form a Helmholtz resonator for low to medium speeds of the motor, especially at about 3,000 rpm. Accordingly, the length and diameter of the induction tube as well as the volume of the housing must be tuned for this speed range. A further improvement can be made according to the invention if the closed supplementary induction tube forms a tubular projection on the housing and for these speeds it is a so-called quarter-wavelength tube, which means that the length of the tubular projection, especially up to the closing means, corresponds approximately to one-quarter or an uneven multiple of one quarter of the wavelength $\lambda$ of the sound generated. Thus a standing wave builds up in the quarter-wavelength tube and produces a suppression of noise.

In another embodiment of the invention, for high speeds of the motor, especially from about 3,500 rpm, at least one supplementary induction tube is open. If a plurality of closeable supplementary induction tubes are used, additional tubes can be opened or closed as the speed increases. Preferably the housing forms together with its volume and geometry, i.e., the length and cross section of the tubes, a Helmholtz resonator for high rotational speeds. Another advantage in this case is that with the additional induction more air can be fed to the engine for the attainment of higher power and improved efficiency.

It is true that the optimum damping occurs basically at one frequency or in a very narrow frequency range, yet the suppression is still sufficient at frequencies above it. The choice of the speed ranges is given above only by way of example and, since they can be chosen freely by changing the geometry, they can be however desired. For example, frequencies that are found to be especially obnoxious, or frequencies that should be avoided, can be given the maximum suppression. By increasing the number of closeable supplementary tubes, a refined tuning can be achieved, and with it an improved suppression of induction noises.

Advantageously, the closing means are in the form of movable flaps, which if preferably round flaps can be rotated on their central axis. A preferred means for their operation is an electrical servo motor, which can preferably be flange-mounted directly on the supplementary induction tube. The motor is operated by a control, as for example the electronic control of the internal combustion engine. Another possibility is a pneumatic operation by means of the vacuum developed in the intake tract, or a direct mechanical coupling which operates the closing means directly according to the rotational speed in the manner of a centrifugal force regulator or the like. In one preferred embodiment of the invention, the induction tubes open into the housing at a distance apart from one another, especially from different sides and/or in different directions, and they preferably can be mounted at a certain distance from the housing on tubular projections or the like formed thereon. Due to the difference in the way the tubes lead into the housing they can be independent of one another in their action in suppressing noise. The housing and/or the induction tubes can be made of a thermoplastic, as for example polypropylene or polyamide, preferably by injection molding. Since they are fastened on short tubular stems extending from the housing, they can be secure against vibration.

At least one induction tube, preferably the always open one, terminates in the area of a bumper or of an upper fastening on the body, especially behind it, and at least one supplementary induction tube terminates in the area of the wheel housing, advantageously above the wheel casing. Air intake at different points prevents interference; air intake in the area of the wheel housing by the supplementary induction tube assures a supply of cold air which is especially advantageous to a high rotational speed and therefore to the power range of the motor.

In one embodiment of the invention an air induction device is provided whose always open induction tube terminates for air intake in the motor compartment behind the bumper, and whose supplementary induction tube, which has at its end a round rotary valve operated by an electric servo motor, runs from the housing and ends in the area above the wheel casing. At low and medium speeds, especially up to about 3,000 rpm, the valve closes the supplementary induction tube, while the closed tubular projection is a quarter-wavelength tube for the suppression of noise produced by the air intake, and the housing with the open induction tube forms a Helmholtz resonator. At high speeds, especially above about 3,500 rpm, the valve is opened for the additional aspiration of air through the supplementary induction tube, while preferably the total length of the supplementary induction tube and its cross section form with the housing and the open induction tube a Helmholtz resonator for the suppression of noise at these speeds.

By providing an always open induction tube, the number and cost of closing means needed can be considerably lowered, as well as liability to malfunction. The invention is based advantageously not on noise suppression by alternation between tubes, but by the additional use of at least one supplementary induction tube.

These and additional features of preferred embodiments of the invention will be found not only in the claims but also in the description and the drawings, the individual features being applicable individually or severally in the form of subcombinations in the embodiment of the invention and in other fields and may represent advantageous as well as independently patentable embodiments, for which protection is hereby claimed.

The division of the application into individual sections and subtitles do not limit the general validity of the statements made thereunder.

BRIEF DESCRIPTION OF THE DRAWINGS

An embodiment of the invention is illustrated in the drawings and is further explained below. In the drawings.

DESCRIPTION OF A PREFERRED EMBODIMENT

Figure 1:
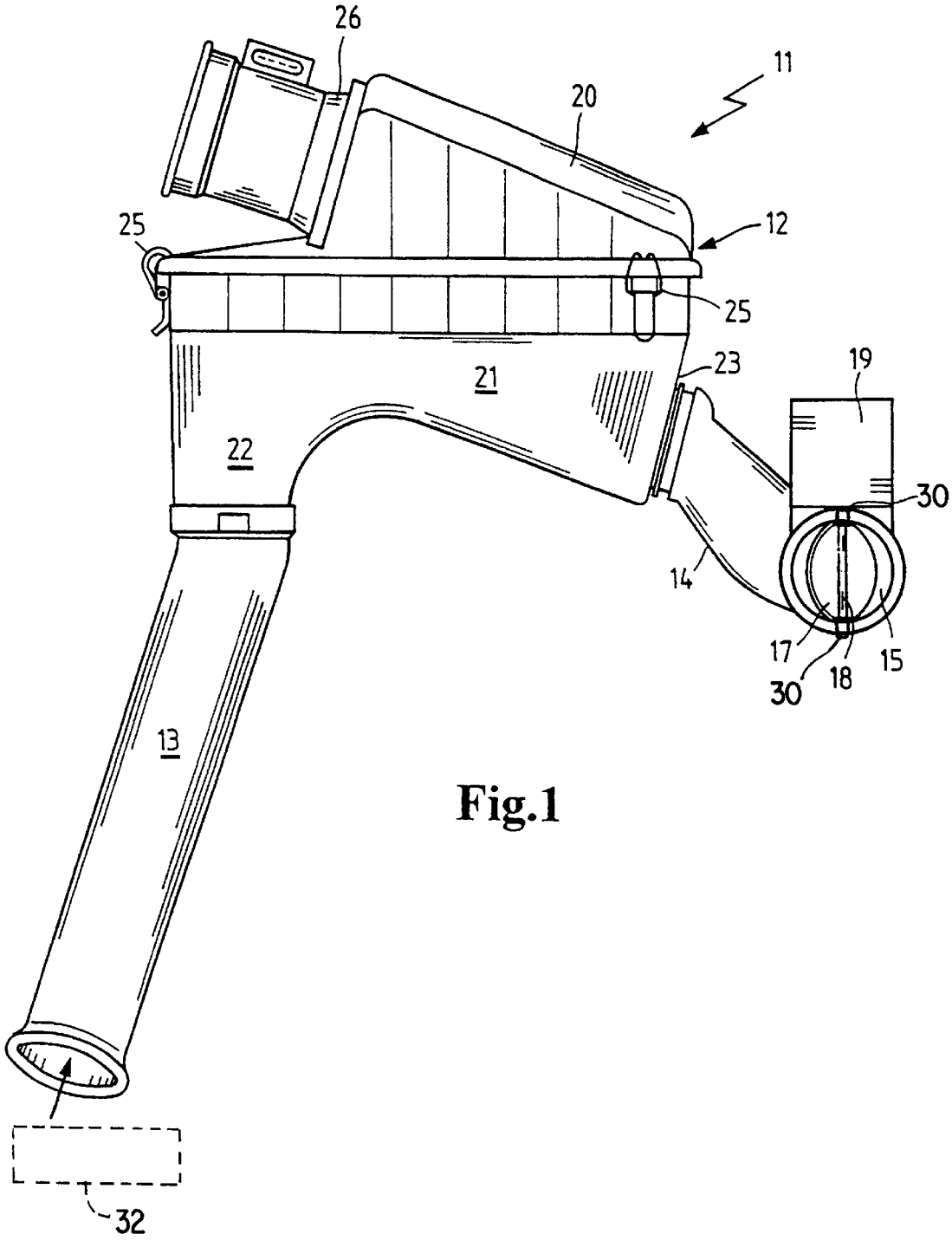
FIG. 1 is a side elevation of an air induction device according to the invention, wherein a half-opened rotary valve can be seen in the supplementary induction tube.

In FIG. 1 there is shown an air induction device 11 which comprises a housing 12 from which a substantially straight induction tube 13 extends downward with a bend to the left in the drawing, and a supplementary induction tube 14 extends downward to the right and has a rotary valve 17 which can be seen through an end opening 15. This rotary valve 17 can rotate about a shaft 18 which is journaled or flange-mounted at 30 in the supplementary induction tube 14. The rotary valve 17 is operated by a servo motor 19 fastened to the supplementary induction tube 14, which is, for example, an electric motor with gears and a control. The supplementary induction tube 14 extends from the housing 12 with a bend out of the plane of the drawing, so that its more precise orientation can be seen in FIG. 2. The cross section, however, is approximately circular as in the induction tube 13, and is constant over substantially the length of the tube.

The two part housing 12 comprises an upper part 20 and a lower part 21 which are releasably held together by snap-action clips 25. As it can be seen, the induction tube 13 is fastened to a tubular stem 22 projecting from the lower part 21 of the housing 12, for example by snap action, cementing or the like. In like manner the supplementary induction tube 14 is fastened to a tubular stem 23 projecting from the lower part 21. On the upper left in the drawing, a connecting tubular stem 26 branches from the upper part 20, and on it an air tube, not shown, is fastened, which feeds the aspirated air filtered through an air filter contained in the housing 12 to the internal combustion engine which also is not shown.

Figure 2:
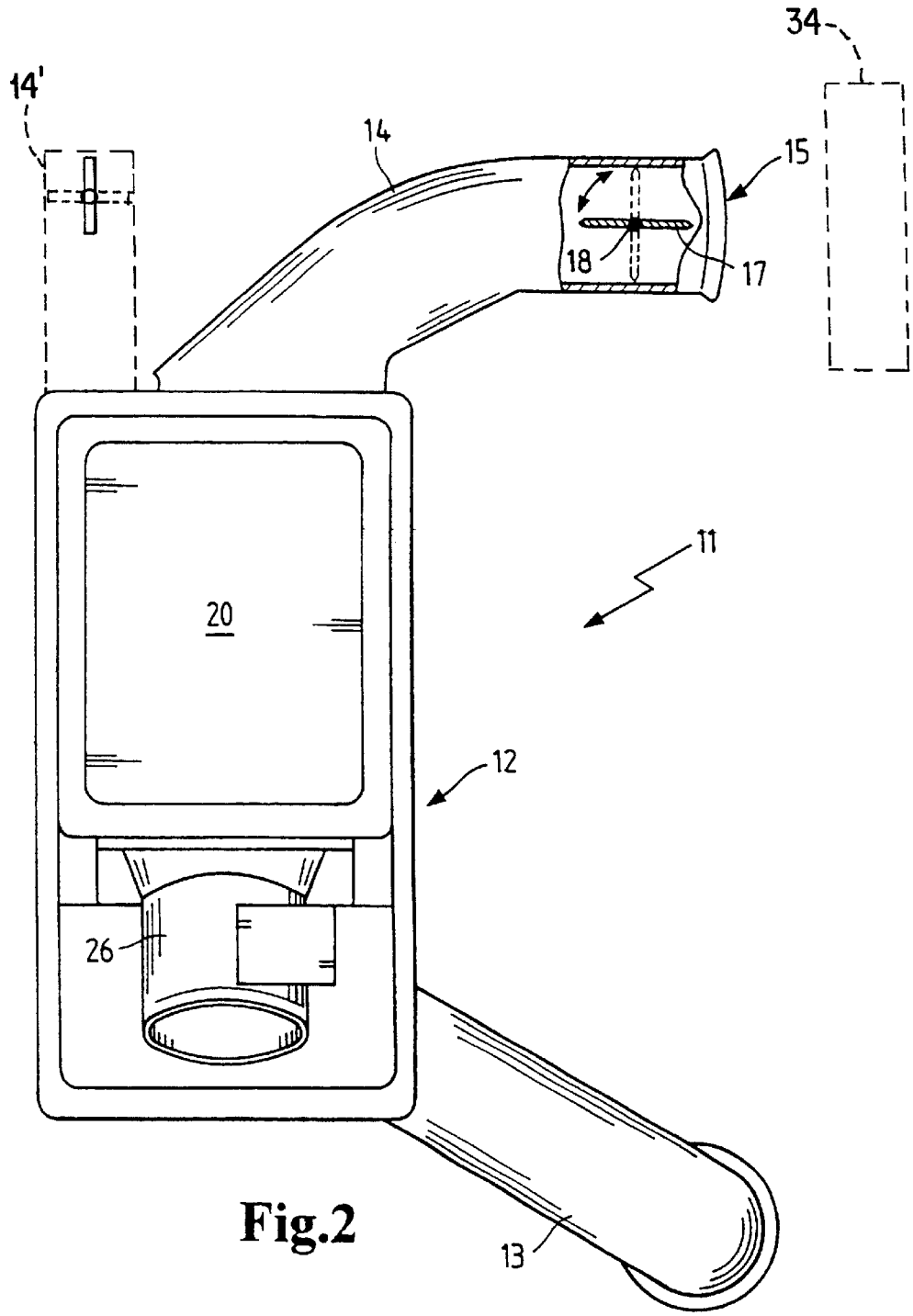
FIG. 2 is a top plan view of the housing with induction tube and supplementary induction tube, showing the position of the rotary valve in the end portion of the supplementary induction tube.

The plan view of the air intake device 11 in FIG. 2 shows the approximately rectangular plan of the housing 12 and its upper part 20 with the connecting stem 26. The induction tube 13 which extends downward to the right in this drawing has, as can be seen by comparing FIGS. 1 and 2, a greater length than the supplementary induction tube 14.

It can be clearly seen in what range the rotary valve 17 can be rotated about its axis by the servo motor, which here is omitted for greater clarity. The position represented by solid lines is the OPEN position in which the valve is disposed approximately in line with the length of the supplementary induction tube. Illustrated in broken lines is the CLOSED position in which the valve 17 completely close the supplementary induction tube. In the illustrated embodiment the rotary valve 17 is located a short distance of several centimeters from the end opening 15. However, just as possible is a position directly at the end, or else closer to the housing 12. The rotary valve 17 and the supplementary induction tube 14 can have a sealing means or the like in the area of attachment so as to close the supplementary induction tube more securely airtight.

For the sake of clarity, fastening means for the air induction device 11 by which it is mounted in the engine compartment is not shown. However, depending on their purpose, they can be formed on the housing 12 and/or on at least one of the tubes 13 or 14. Likewise, there are many possibilities for fastening the servo motor 19 on either the engine or the body of the vehicle.

From the two drawings it is clearly apparent that the induction tubes open into the housing 12 or its lower part 21 both at different points and in different directions. This can be advantageous to the achievement of the action pursued by the invention, but it is not considered essential. Depending on the available space there is a broad range of possibilities for the design.

OPERATION

Not illustrated in the drawings is a sensing system for measuring the speed or power of the internal combustion engine, which actuates the rotary valve 17 by means of the servo motor 19 depending on the sensed rotational speed or power. How the operation of the rotary valve can be controlled in an advantageous manner will now be described.

In the low-throttle operation of the motor, i.e., at low speeds, the supplementary induction tube 14 is closed by the rotary valve 17, and the internal combustion engine aspirates air only through the open induction tube 13. Then the length of the supplementary induction tube 14, i.e., the distance between the housing 12 and lower part 21 and the point at which the rotary valve closes the supplementary induction tube, is calculated to form a quarter-wavelength tube for the housing. The housing itself forms with the induction tube 13 a Helmholtz resonator for low frequencies, especially below about 1,000 rpm of the internal combustion engine. This signifies that the volume of the housing 12 and the length and geometry of the induction tube 13 below 1,000 rpm satisfies the requirement of the Helmholtz equation. The action of this Helmholtz resonator in suppressing noise is not, however, limited to a particular speed or range, but begins in this range and continues to act, slightly more weakly, at higher speeds. This noise suppression is reinforced by the quarter-wavelength tube formed by the closed supplementary induction tube 14 which corresponds in length to one-quarter of the wavelength of the air noise at low speeds. Thus a suppression of noise at low speeds is achieved according to the invention.

At higher speeds, from about 3,500 rpm, for example, the rotary valve 17 is opened by the servo motor 19, so that substantially the entire cross section of the supplementary induction tube 14 is available for additional aspiration of air. Thus the effective air intake cross section is expanded. This has, for one thing, the advantage that, at higher speeds, the additional intake air required by the internal combustion engine is available through the supplementary induction tube. The supplementary induction tube offers the further advantage that with it aspiration of air is possible at a point other than through the induction tube 13, so that cold air can be aspirated with preference to increase the power output of the engine.

A further aspect of the invention envisions that the supplementary induction tube 14 is designed in cross section and overall length, i.e., from the housing 12 through the area of the rotary valve 17 to the end opening 15, so as to form together with the induction tube 13 and the housing 12 a Helmholtz resonator for higher speeds. Thus a new optimum adaptation of the air induction system to a second speed range is achieved for the best possible noise suppression. Due to the variety of possibilities for the individual factors, a broader freedom of configuration is provided for the housing as well as tubes 13 and 14.

In another embodiment of the invention, it is possible to provide a greater number of supplementary induction tubes (as shown at 14') with closing means on the housing 12, thus permitting finer and therefore better tuning as well as an expansion of the induction cross section. The supplementary induction tubes can in this case be opened alternatively or additionally when the rotational speed increases.

In yet another embodiment of the invention, the air induction device is provide such that the always open induction tube 13 terminates for air intake in the motor compartment behind the bumper 32 (as schemetically shown in FIG. 1), and whose supplyementary induction tube 14, which has as its end a round rotary valve 17 operated by an electric servo motor 19, run from the housing ans ends in the area above the wheel housing 34 (as substantially shown in FIG. 2.).

What is claimed is:

1. An air induction device for an internal combustion engine comprising:

a two-part air filter housing and an air intake formed by two induction tubes having different lengths, wherein at least one of said induction tubes is a supplementary induction tube having a closing element associated therewith, wherein the air filter housing comprises a substantially rectangular shape comprising an upper part and a lower part which are releasably connected to one another, and wherein two tubular stems project from the lower part and each tubular stem comprises a fastening mechanism for connection to an induction tube, the two induction tubes each being fastened to one of the tubular stems and extending from the lower part in a downward direction.

* * * * *